US005178550A

United States Patent [19]

Fusselman et al.

[11] Patent Number: 5,178,550

[45] Date of Patent: Jan. 12, 1993

[54] HANDLED STIFFENER FOR DEEP WELL IGNITION CABLE TERMINAL ASSEMBLY

[75] Inventors: Rand D. Fusselman, Southington; Kenneth B. Germ, Niles, both of Ohio

[73] Assignee: General Motors Corporation, Detroit, Mich.

[21] Appl. No.: 513,382

[22] Filed: Apr. 23, 1990

[51] Int. Cl.[5] ..... H01R 13/44

[52] U.S. Cl. ..... 439/128; 439/125

[58] Field of Search ..... 439/125, 127, 128, 853; 313/51; 123/193 C, 169 PH

[56] References Cited

U.S. PATENT DOCUMENTS 4,884,977 12/1989 Sturdevan ..... 439/125

FOREIGN PATENT DOCUMENTS 1007431 2/1952 France ..... 439/125

2165000 4/1986 United Kingdom ..... 123/169 PH

*Primary Examiner*—Eugene F. Desmond

*Attorney, Agent, or Firm*—F. J. Fodale

[57] ABSTRACT

An ignition cable terminal assembly for connecting an ignition cable to a spark plug terminal which is located in a deep well in an internal combustion engine has a handled stiffener for manipulating the ignition cable terminal assembly into engagement with the spark plug terminal. The stiffener comprises first and second members of relatively rigid thermoplastic material. The first member is a columnar arrangement of a lower collar portion which holds an elastomeric boot of the ignition cable terminal assembly, an intermediate channel portion for loading the elastomeric boot into the lower collar portion, and an upper handle portion for manipulating the stiffener. The second member is a closure member for the channel portion which including a clip for gripping the portion of the ignition cable which is disposed in the channel and a stop for holding the elastomeric boot down in the lower collar portion of the first member. The intermediate channel portion of the first member and the closure member have complementary semi-circular grooves at their respective upper ends which hold a seal ring.

12 Claims, 2 Drawing Sheets

HANDLED STIFFENER FOR DEEP WELL IGNITION CABLE TERMINAL ASSEMBLY

BACKGROUND OF THE INVENTION

This invention relates generally to ignition cable terminal assemblies and more particularly to stiffeners for ignition terminal assemblies which are adapted for connection to spark plugs which are located in deep recesses or wells in an internal combustion engine.

In the past such stiffeners have typically included a handle for manipulating the terminal assembly into and out of engagement with the spark plug terminal which is located in the bottom of the deep well. See for instance, U.S. Pat. No. 4,637,358 issued to Yoskihi Yano et al Jan. 20, 1987; U.S. Pat. No. 4,701,662 issued to Hidenori Yamanashi et al Oct. 20, 1987; U.S. Pat. No. 4,810,198 issued to Ronald P. Sturdevan Mar. 7, 1989; U.S. Pat. No. 4,824,385 issued to Ronald P Sturdevan Apr. 25, 1989; and U.S. Pat. No. 4,906,202 issued to Kenneth B. Germ Mar. 6, 1990 which is assigned to the assignee of this invention.

In some instances these handled stiffeners have been used in conjunction with ignition cable terminal assemblies having an elastomeric boot housing a terminal and an end portion of the ignition cable to which the terminal is attached such as the arrangements shown in U.S. Pat. Nos. 4,810,198 and 4,824,385.

SUMMARY OF THE INVENTION

The object of this invention is to provide an improved handled stiffener for an ignition cable terminal assembly of the type which has an elastomeric boot which houses a terminal and an end portion of the ignition cable to which the terminal is attached.

One feature of the invention is that the improved handled stiffener has a collar portion of one piece construction for holding the elastomeric boot and a coaxial channel portion for loading the elastomeric boot into the top of the collar portion.

Another feature of the invention is that the improved handled stiffener may be configured to interlock with the elastomeric boot so as to prevent relative rotation between the collar portion and the elastomeric boot.

Another feature of the invention is that the improved handled stiffener has an attached stop for holding the elastomeric boot down in the collar portion.

Another feature of the invention is that the improved handled stiffener has a closure for the channel portion which increases the torsibnal rigidity of the stiffener.

Yet another feature of the invention is that the closure member has means to grip and center the ignition cable disposed in the channel portion.

Yet another feature of the invention is that the improved handled stiffener has a closure member which cooperates with the channel portionto carry a circular seal for sealing the upper end of a deep well into which the ignition cable terminal assembly and stiffener are inserted.

Still yet another feature of the invention is that the improved handled stiffener has an integral handle portion which is adapted to grip ignition cable exiting the channel portion and direct the ignition cable in a predetermined direction.

Other objects and features of the invention will become apparent to those skilled in the art as disclosure is made in the following detailed description of a preferred embodiment of the invention which sets forth the best mode of the invention contemplated by the inventors and which is illustrated in the accompanying sheets of drawing.

DETAILED DESCRIPTION OF THE PREFERRED EMBODIMENT

Figure 2:
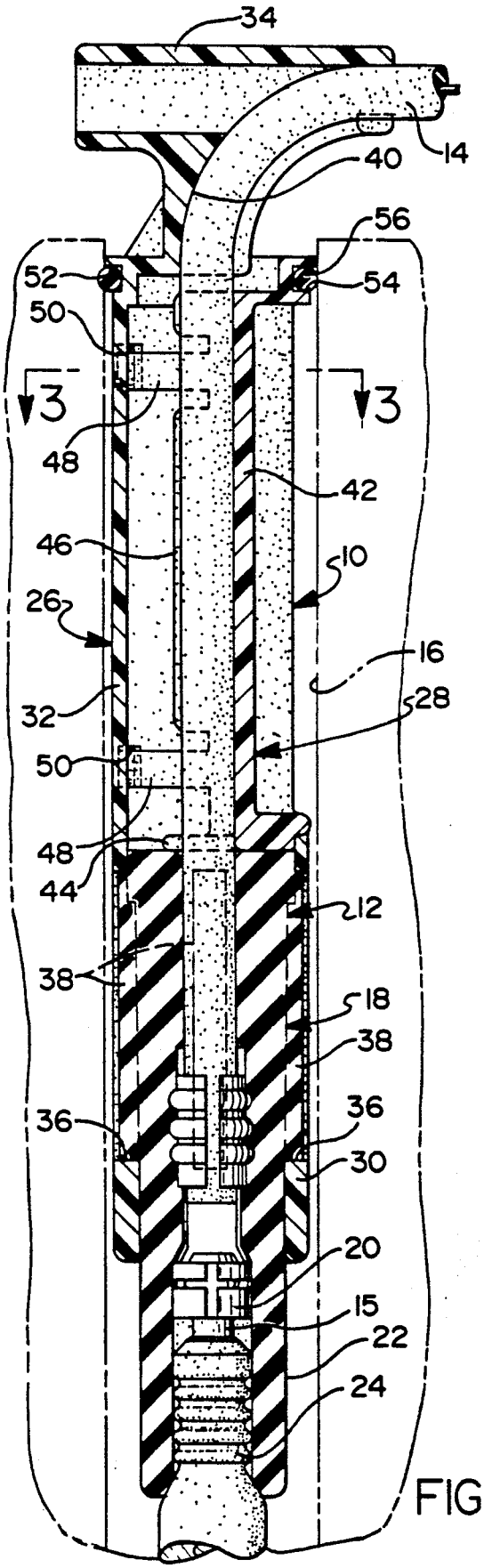
FIG. 2 is a vertical section showing the assembled position of the ignition cable terminal assembly and the handled stiffener which is shown in FIG. 1.

Referring now to the drawing, there is shown an improved handled stiffener 10 for an ignition cable terminal assembly 12 which connects an ignition cable 14 to a terminal 15 of a spark plug which is located in a deep well 16 of an internal combustion engine which is shown in dashed lines in FIG. 2. The ignition cable terminal assembly 12 is of the type which has an elastomeric boot 18 which houses an end portion of the ignition cable 14 and a terminal 20 which is attached to the end portion of the ignition cable 14 in a conventional manner as best illustrated in FIG. 2. The elastomeric boot 20 extends below the terminal 20 to provide a lower seal 22 which sealingly engages an insulator portion 24 of the spark plug when the terminal assembly 12 is plugged onto the spark plug terminal 15.

The handled stiffener 10 comprises first and second members 26 and 28 of relatively rigid thermoplastic plastic material such as a glass filled nylon. The first member 26 is a columnar arrangement of a lower collar portion 30, an intermediate channel portion 32 and an upper handle portion 34.

The lower collar portion 30 engages and holds a major upper portion of the elastomeric boot 18 so that the socket portion of the terminal 20 and the lower seal 22 of the elastomeric boot 18 which engage the spark plug are below the lower collar portion 30 as shown in FIG. 2. This minimizes the interference of the stiffener 10 when the terminal assembly 12 is plugged onto the spark plug.

The lower collar portion 30 has four circumferentially spaced, axially oriented slots 36 which receive axial ribs 38 of the elastomeric boot 18 to hold the elastomeric boot 18 axially as well rotationally steadfast in the lower collar portion 30 of the stiffener member 26.

Figure 1:
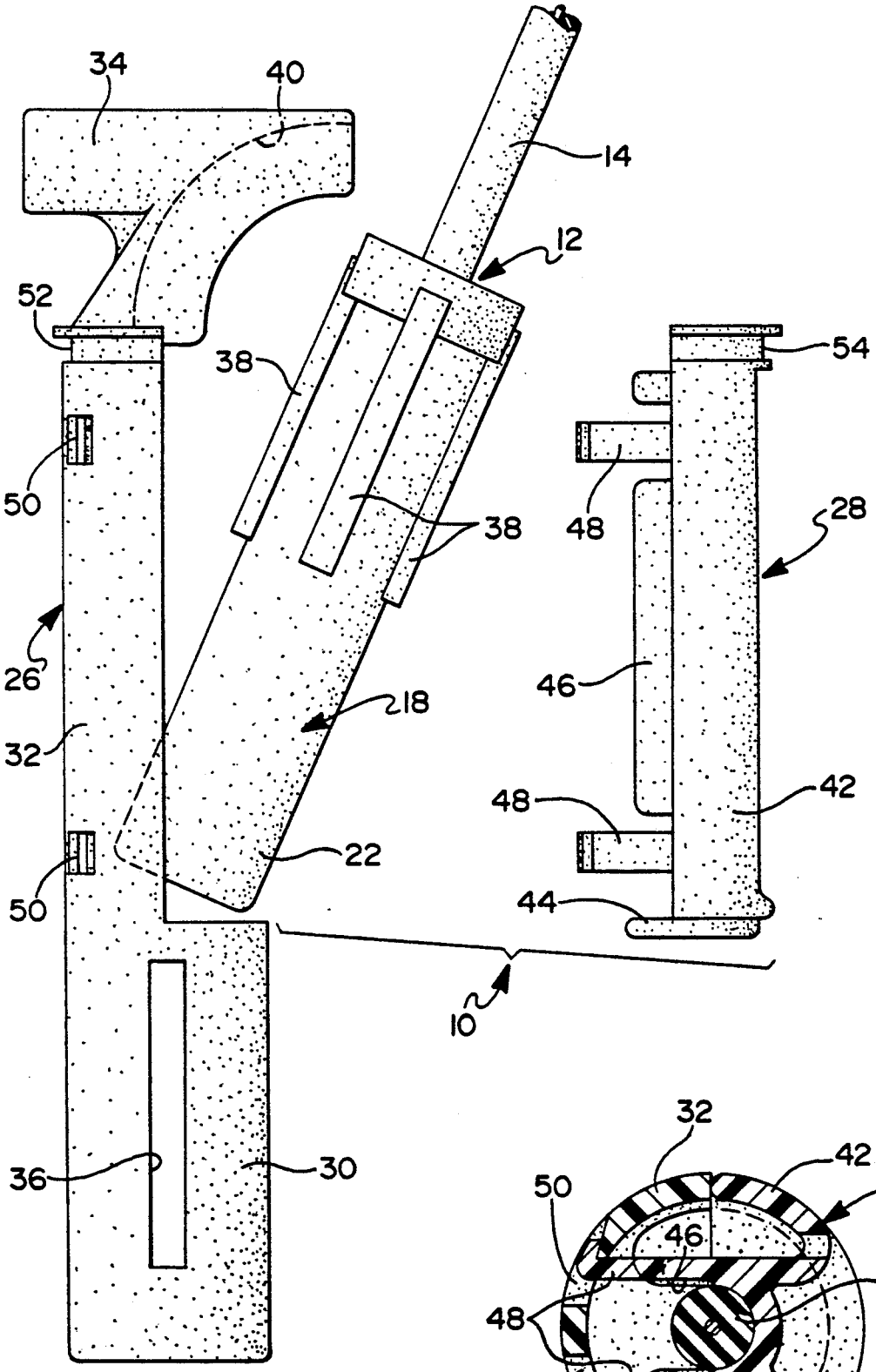
FIG. 1 is an exploded front view showing an ignition cable terminal assembly being loaded into a handled stiffener in accordance with the invention.

The intermediate channel portion 32 is a semicircular coaxial extension of the lower collar portion 30 which communicates with the lower collar portion 30. The intermediate channel portion 32 is used for loading the elastomeric boot 18 into the lower collar portion 30 through the upper end of the lower collar portion 30 by inserting the elastomeric boot 18 into the open side of the intermediate channel portion 32 as shown in FIG. 1. The intermediate channel portion 32 is elongated but it may be shorter than the elastomeric boot 18 because the lower seal lip 22 bends to accommodate insertion into the lower collar portion 30 via the intermediate channel portion 32. However, the length of the intermediate channel portion 32 should be approximately at least as much as the length of the upper portion of the elastomeric boot 18 from the top of elastomeric boot to the bottom of the terminal 20 which is inside the elastomeric boot 18 so that the terminal 20 is not damaged during insertion.

The upper handle portion 34 for manipulating the handled stiffener 10 is generally T-shaped and integrally attached to a top wall at the upper end of the channel portion 32. The upper handle portion 34 is formed to include a curved groove 40 which communicates with the intermediate channel portion 32 at one end and leads out of the cross bar of the T-shaped handle portion 34 at the other end. The curved groove 40 is sized and shaped with respect to the diameter of the ignition cable 14 so that the curved groove 40 grips ignition cable 14 exiting from the intermediate channel portion 32 and directs the ignition cable 14 in a predetermined perpendicular direction as best shown in FIG. 2.

The second member 28 of the handled stiffener 10 is a closure for the intermediate channel portion 32 of the first member 26. This closure member comprises a generally semi-cylindrical shell 42 which complements the semi-cylindrical channel portion 32 when the closure member 28 is attached to the stiffener member 26 as shown in FIG. 2. The closure member 28 includes a stop 44 at its lower end which engages the top of the elastomeric boot 18 to hold the elastomeric boot 18 down in the lower collar portion 30 of the stiffener member 26. This supplements the axial retention the ribs 38 and slots 36 in designs having such a feature.

The closure member 28 further includes a clip 46 which has an axial groove centered in the intermediate portion of the stiffener 10. The groove is sized and shaped with respect to the diameter of the ignition cable 14 so that the clip 46 grips and centers the portion of the ignition cable 14 which is disposed in the channel portion 32 when the closure member 28 is attached to the stiffener member 26.

The closure member 28 also has two pairs of latch arms 48 which cooperate with two pairs of slots 50 in the intermediate channel portion 32 to secure the closure member 28 to the stiffener member 26. The secure attachment of the closure member 28 improves the torsional rigidity of the stiffener 10 substantially particularly in the intermediate area where the closure member 28 complements the channel portion 32.

The intermediate channel portion 32 and the closure member 28 also have complementary part circular grooves 52, 54 at their respective upper ends which hold a seal ring 56 for sealing the upper end of the deep well 16.

Figure 3:
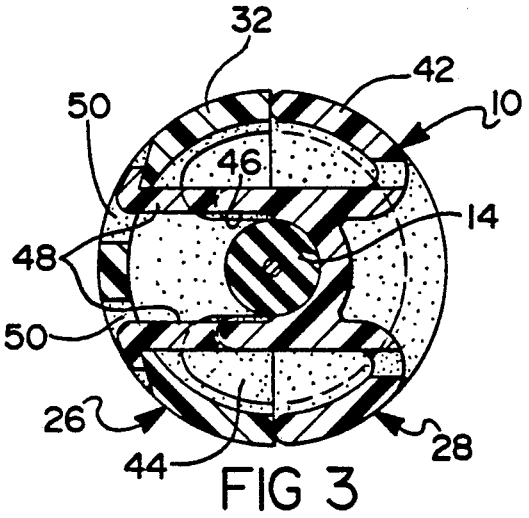
FIG. 3 is a sectional view of the ignition cable terminal assembly and handled stiffener taken substantially along the line 3—3 of FIG. 2 looking in the direction of the arrows.
Figure 4:
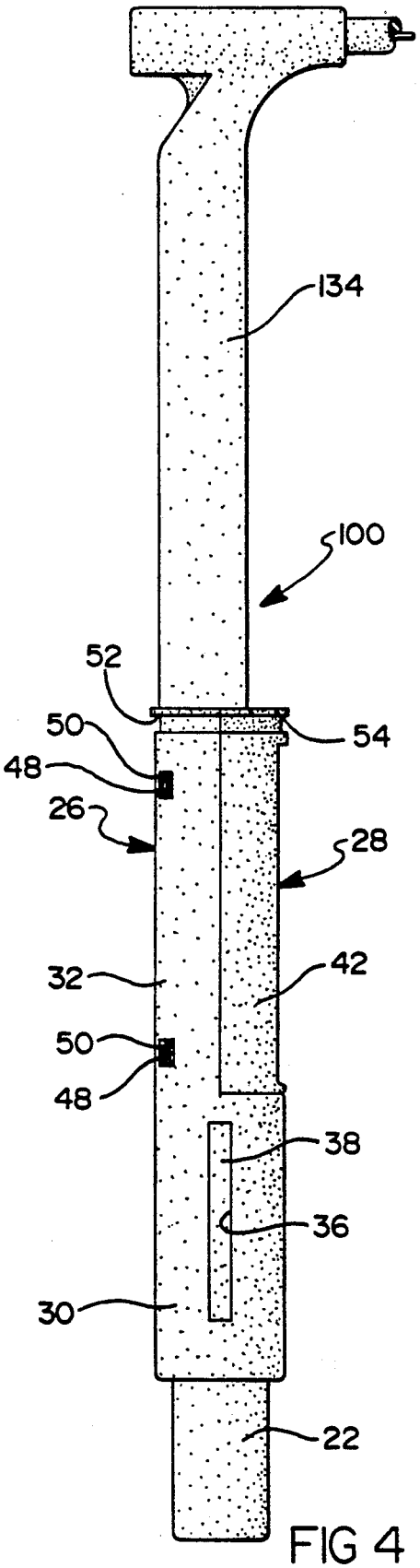
FIG. 4 is a front view of a modified handled stiffener assembled to an ignition cable terminal assembly.

The improved stiffener 10 which is shown in FIGS. 1, 2 and 3 has a short handled portion 34. The modified stiffener 100 which is shown in FIG. 4 has a handled portion 134 which is much longer. In fact, it is over half the length of the stiffener 100. The stiffener 100 is otherwise the same as the improved stiffener 10 and corresponding parts are identified with the same numerals.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A handled stiffener for an ignition cable terminal assembly for connecting an ignition cable to a terminal of a spark plug which is located in a deep well in an internal combustion engine in which the ignition cable terminal assembly has a terminal which is attached to an end of an ignition cable and which is disposed in an elastomeric boot which is adapted to sealingly engage an insulator portion of the spark plug comprising:

first and second members of relatively rigid plastic material;

the first member having a lower collar portion for holding an elastomeric boot of an ignition cable terminal assembly, an intermediate open channel portion which communicates with the lower collar portion for loading the elastomeric boot into the lower collar portion through an upper end of the lower collar portion, and an upper handle portion for manipulating the stiffener; and the second member being attached to the first member and including a stop for holding the elastomeric boot down in the lower collar portion of the first member.

2. The handled stiffener as defined in claim 1 wherein the second member is attached to the intermediate open channel portion so as to increase the torsional rigidity of the intermediate open channel portion.

3. The handled stiffener as defined in claim 1 wherein the intermediate open channel portion of the first member is elongated and part cylindrical and the second member forms a closure for the intermediate open channel portion which increases the torsional rigidity of the stiffener.

4. The handled stiffener as defined in claim 1 wherein the intermediate open channel portion receives a portion of the ignition cable and the second member includes a clip for gripping and centering the ignition cable which is disposed in the channel portion.

5. The handled stiffener as defined in claim 3 wherein the intermediate open channel portion receives a portion of the ignition cable and the second member includes a clip for gripping and centering the ignition cable which is disposed in the channel.

6. A handled stiffener for an ignition cable terminal assembly for connecting an ignition cable to a spark plug terminal which is located in a deep well in an internal combustion engine in which the ignition cable terminal assembly has a terminal which is attached to an end of an ignition cable and which is disposed in an elastomeric boot which is adapted to sealingly engage an insulator portion of the spark plug comprising:

a first member of relatively rigid plastic material which has a lower elongated collar portion for receiving an elastomeric boot of an ignition cable terminal assembly, the first member having an intermediate, elongated, open channel portion which communicates with the lower collar portion for loading the elastomeric boot into the lower collar portion through an upper end of the lower collar portion, the first member having an upper handle portion for manipulating the stiffener, and a second member of relatively rigid plastic material which is attached to the intermediate, elongated, open channel portion so as to increase the torsional rigidity of the stiffener, the second member including a stop for holding the elastomeric boot down in the lower collar portion of the first member.

7. A handled stiffener for an ignition cable terminal assembly for connecting an ignition cable to a spark lug terminal which is located in a deep well in an internal combustion engine in which the ignition cable terminal assembly has a terminal which is attached to an end of an ignition cable and which is disposed in an elastomeric boot which is adapted to sealingly engage an insulator portion of the spark plug comprising:

a first member of relatively rigid plastic material which has a lower elongated collar portion for receiving an elastomeric boot of an ignition cable terminal assembly, the first member having an intermediate, elongated, open channel portion which communicates with the lower collar portion for loading the elastomeric boot into the lower collar portion through an upper end of the lower collar portion, the first member having an upper handle portion for manipulating the stiffener, a second member of relatively rigid plastic material which is attached to the intermediate, elongated, open channel portion so as to increase the torsional rigidity of the stiffener, the second member including a stop for holding the elastomeric boot down in the lower collar portion of the first member, and the open channel portion of the first member and the second member having complementary part circular grooves at their respective upper ends which hold a seal ring for sealing an upper end of a deep well in which the ignition cable terminal assembly and handled stiffener are inserted.

8. The handled stiffener as defined in claim 7 wherein the open channel portion receives a portion of the ignition cable and the second member forms a closure for the open channel member which includes a clip for gripping and centering the ignition cable which is disposed in the channel.

9. A handled stiffener for an ignition cable terminal assembly for connecting an ignition cable to a spark plug terminal which is located in a deep well in an internal combustion engine in which the ignition cable terminal assembly has a terminal which is attached to an end of an ignition cable and which is disposed in an elastomeric boot which is adapted to sealingly engage an insulator portion of the spark plug comprising:

first and second members of relatively rigid plastic material;

the first member having a lower collar portion for receiving an elastomeric boot of an ignition cable terminal assembly, an intermediate, elongated, semi-circular channel portion which communicates with the lower collar portion for loading the elastomeric boot into the lower collar portion through an upper end and for receiving a portion of the ignition cable when the elastomeric boot is loaded into the lower collar portion, and an upper handle portion for manipulating the stiffener; and the second member being attached to the first member and forming a closure for the intermediate channel portion, the second member including a clip for gripping and centering the ignition cable which is disposed in the channel and a stop for holding the elastomeric boot down in the lower collar portion of the first member, and the intermediate channel portion of the first member and the second member having complementary semi-circular grooves at their respective upper ends which hold a seal ring for sealing an upper end of a deep well.

10. The handled stiffener as defined in claim 9 wherein the lower collar portion of the first member has a plurality of circumferentially spaced axially oriented slots which are adapted to receive axially oriented ribs of the elastomeric boot to prevent relative rotation between the boot and the stiffener when the elastomeric boot is loaded into the lower collar portion.

11. The handled stiffener as defined in claim 9 wherein the handle portion has a groove which communicates with the intermediate channel portion and which is adapted to grip ignition cable exiting from the intermediate channel portion and direct the ignition cable in a predetermined direction.

12. The handled stiffener as defined in claim 10 wherein the handle portion has a groove which communicates with the intermediate channel portion and which is adapted to grip ignition cable exiting from the intermediate channel portion and direct the ignition cable in a predetermined direction.

* * * * *